US005390458A

United States Patent [19]

Menchetti

[11] Patent Number: 5,390,458

[45] Date of Patent: Feb. 21, 1995

[54] WALLBOARD PROTECTIVE EDGE TAPE FOR MOUNTING BOARD

[75] Inventor: Robert J. Menchetti, Buffalo, N.Y.

[73] Assignee: National Gypsum Company, Charlotte, N.C.

[21] Appl. No.: 63,800

[22] Filed: May 20, 1993

[51] Int. Cl.[6] ..... E04B 2/00

[52] U.S. Cl. ..... 52/417; 52/98; 52/99; 52/416; 52/DIG. 16; 428/43; 428/122; 428/192

[58] Field of Search ..... 52/98, 99, 416, 417, 52/DIG. 16; 428/40, 41, 43, 122, 192

[56] References Cited

U.S. PATENT DOCUMENTS

| | | | |
|---|---|---|---|
| 1,724,740 | 8/1929 | Utzman . | |
| 3,121,649 | 2/1964 | Oliver | 52/DIG. 16 |
| 3,468,086 | 9/1969 | Warner | 52/DIG. 16 |
| 4,069,640 | 1/1978 | Dawdy . | |
| 4,586,308 | 5/1986 | Jennings | 52/417 |
| 5,087,310 | 2/1992 | Robinette . | |
| 5,311,717 | 5/1994 | Yount et al. | 52/417 |

*Primary Examiner*—Carl D. Friedman
*Assistant Examiner*—Christopher Todd Kent
*Attorney, Agent, or Firm*—Marshall, O'Toole, Gerstein, Murray & Borun

[57] ABSTRACT

A wallboard package having edge protective tape which connects two wallboards face-to-face, with an adhesive film on the tape inner surface adapted for use in affixing the wallboards to wall studs.

18 Claims, 3 Drawing Sheets

WALLBOARD PROTECTIVE EDGE TAPE FOR MOUNTING BOARD

This invention relates to packaging predecorated wallboard with a novel protective edge tape which has adhesive on portions of the tape suitable for use in mounting the wallboard on wall studs.

BACKGROUND OF THE INVENTION

Predecorated gypsum wallboard is packaged by placing two 4-foot-wide and about 8- to 12-foot-long, 5/16-inch- to $\frac{5}{8}$-inch-thick boards together, face-to-face, and affixing the two boards together using protective edge tape. The protective edge tape extends the full length of the boards at the two edges and is wide enough to be adhered to about a 2-inch-wide area of the back face of each board. The protective edge tape is not adhered to the edge surfaces of the boards.

When a consumer is ready to use the wallboards, the unadhered center portion of the protective edge tape is torn away and disposed of. The wallboards are then, one at a time, affixed to wall framing members, using an adhesive which is first placed on the studs followed by placing the wallboard against the adhesive on the stud.

SUMMARY OF THE INVENTION

The present invention is directed to a novel protective edge tape for packaging wallboard and for a secondary function as an instrumental element in the affixing of the wallboard to a structural base, such as a stud. In particular, the protective edge tape has tear-resistant portions and has an adhesive applied to the inner surface of the unadhered center portion of the tape.

This center portion can then be used in any of several ways to assist in mounting the wallboard. If a pressure sensitive adhesive is used on the inner surface of the tape center portion, then release paper is placed over the adhesive until the board is being mounted. To mount the board, the tape is severed along the centerline, the release paper is removed, the half of the center portion still affixed to the board is folded back 270°, and the board is mounted so that the pressure sensitive adhesive contacts a structural base, such as a stud, whereat the board remains affixed to the structural base.

An alternative method of mounting the above-described board and tape is to sever the tape along one edge of the center portion, fold it back 90°, place the board against a structural base, staple the center portion to the structural base, remove the release paper and adhere the adjacent wallboard to the exposed pressure sensitive adhesive.

A still further alternative form of the invention involves a protective edge tape with contact adhesive applied to the inner surface of the center portion of the tape. To mount the wallboards, the tape is severed along the centerline, the half center portion of one wallboard is folded back 90°, the board is placed against a structural base, the half center portion is stapled to the structural base, the half center portion of an adjacent wallboard is folded back 270°, and the two half center portions are adhered together. The contact adhesive used is one which will adhere only to a second surface with the same adhesive.

It is an object of the present invention to provide a wallboard package having a dual-purpose protective edge tape, packaging two wallboards and participating in the attachment of the wallboard to a structural base.

It is also an object to provide a novel wall wherein wallboard is affixed to a structural base by means involving the protective edge tape.

It is a still further object to provide a novel and improved method of both packaging wallboard and mounting wallboard on a structural base.

BRIEF DESCRIPTION OF THE DRAWINGS

These and other objects and advantages will be more readily apparent when considered in relation to the preferred embodiments of the invention as set forth in the specification and shown in the drawings in which.

DESCRIPTION OF THE PREFERRED EMBODIMENTS

Figure 1:
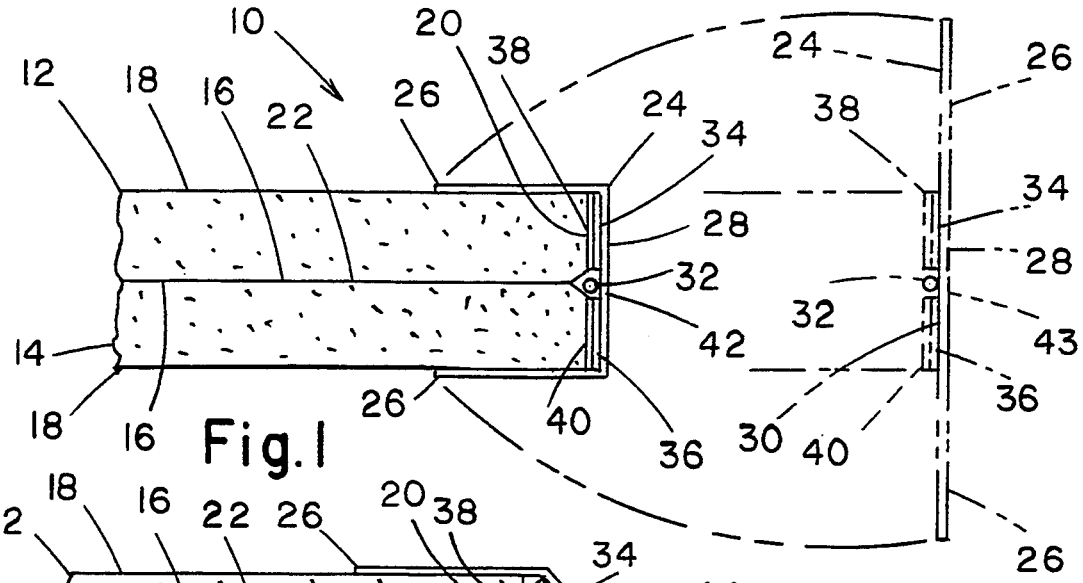
FIG. 1 is an end view of a portion of a wallboard package showing the protective edge tape, both prior to application onto the wallboard and after application.
Figure 2:
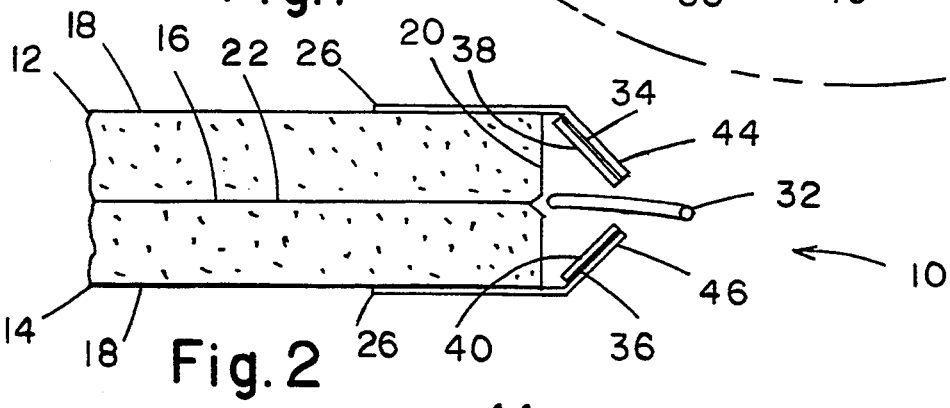
FIG. 2 is an end view of the wallboard package of FIG. 1 as the tear cord is severing the protective edge tape.
Figure 3:
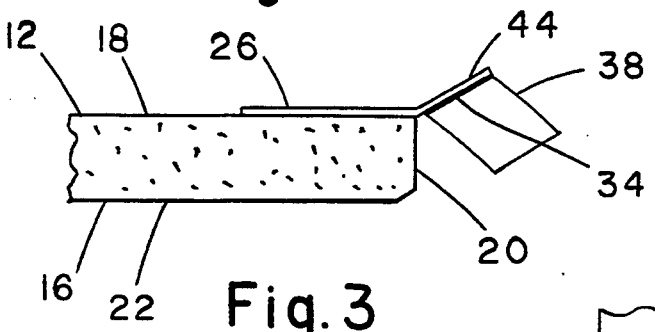
FIG. 3 is an end view of one of the wallboards of FIG. 2 as a half center portion of tape is being folded back and release paper is being removed.

Referring to FIGS. 1–3, there is shown an edge portion 10 of a package of two predecorated gypsum wallboards 12, 14. The two wallboards are, typically, 4-feet wide, about 8–12-feet long and 5/16-$\frac{5}{8}$-inch thick.

Each wallboard 12, 14 has a front face 16, a back face 18 and two side edges 20 (the opposite side edges are not shown). The front face 16 and the side edges 20 are predecorated, such as by a printed polyvinyl chloride facing sheet (not shown) or printing on the face paper 22. To protect the exposed predecorated side edges 20, a novel protective edge tape 24 is wrapped around the side edges 20 of the two wallboards 12, 14.

Edge tape 24 is about three inches wide, made of tear-resistant material, and when used on two $\frac{1}{2}$-inch wallboards 12, 14, has a one-inch-wide portion 26 along each side of the tape 24 which is adhered to the back face 18 of each wallboard 12, 14. Tape 24 has a center portion 28, one-inch wide, disposed over the side edges 20. Center portion 28 has an inner surface 30 along the center of which is disposed a tear cord 32. Inner surface 30 also has two pressure sensitive adhesive films 34, 36; film 34 being on one side of tear cord 32 and film 36 being on the other side of tear cord 32. Each adhesive film 34, 36 has a release liner 38, 40 covering the pressure sensitive adhesive film 34, 36 and separating the adhesive films 34, 36 from the wallboard edges 20.

Tear-resistant tapes 24 can be formed of any thin, strong material, but are preferably formed of a thin, laminated composite including a fabric scrim having square-woven, tension-resistant fiberglass threads, eight threads per inch, with threads extending laterally and longitudinally of the elongate tapes 24 laminated on each face to fiber-reinforced papers in which the fibers are tension-resistant fiberglass threads arranged in both diagonal directions of the tapes 24, spaced apart at about one-half inch spacings. The fiber-reinforced paper may be made from fiber-reinforced paper tapes which are commonly used in wrapping and sealing large packages.

It is also contemplated that the tear-resistant tapes 24 can be formed of other thin, strong materials, including a non-woven, fused, composite layer of a synthetic fiber such as a polyester or polypropylene combined with wood pulp fibers which layer is laminated to a relatively unstretchable 40 to 50 pound Kraft paper; a similar composite layer without the Kraft paper; a non-woven, fused layer of a synthetic fiber such as polyester or polypropylene without wood pulp but laminated to a Kraft paper; a non-woven, fused layer of synthetic fibers such as polyester or polypropylene combined with wood pulp fibers and with fiberglass fibers; any of the above-mentioned layers in which the synthetic fibers have been spun-bonded; any of the above-mentioned layers in which fiberglass fibers with a suitable binder are substituted for the synthetic fibers; any of the above-mentioned layers with a further layer of a woven scrim added to the layer or laminated between two such layers; spun-bonded, non-woven nylon; latex impregnated paper laminated to a Kraft paper; metal screen laminated to a Kraft paper; or a thin metal sheet, such as steel, of about 0.015 inch thickness. In the case of the non-woven examples, the non-woven materials will preferably be of about 3 to 4 ounces per square yard and about 0.018 to 0.023 inch thick. It is contemplated that many other equivalent thin tear-resistant materials may be found suitable for use in accordance with the invention.

The tapes 24 can be made from any thin sheet material of any number of plies if sufficient tear resistance can be provided to support the wallboards 12, 14, as will be understood from the following description of the function of the tapes 24.

FIG. 1 shows the edge protective tape 24 as it is manufactured prior to placement on a pair of predecorated wallboards 12, 14 and also as it is wrapped around the wallboard side edges 20 and adhered in place, the tape edges 26 each being folded 90°, and the center 28 being placed against wallboard edges 20.

When a consumer is ready to mount the two wallboards 12, 14 in the construction of a wall, the tear cord 32 is used to tear the relatively weaker centerline 42 of edge tape 24. The relatively weaker centerline 42 of edge tape 24 can be made relatively weaker either by including a continuous series of short perforations 43 along the centerline 42 or by forming the tape 24 of laminated plies and separating the more tear-resistant plies along the tape centerline 42 during manufacture of the tape 24.

Tearing the relatively weaker centerline 42 leaves wallboard 12 with flap 44 and wallboard 14 with flap 46. Flaps 44, 46 are the two halves of center portion 28, each with an adhesive film 34, 36 and a release liner 38, 40.

Figure 4:
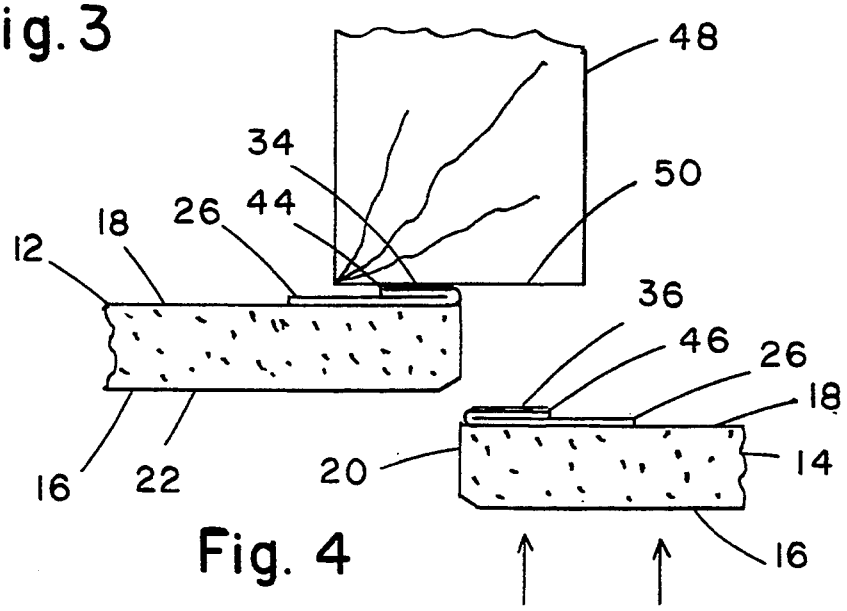
FIG. 4 is an end view of the two wallboards of FIG. 2, one mounted on a wall stud and the second being moved into place adjacent the first.

Release liner 38 is then removed from flap 44; flap 44 is folded back 270°, and the wallboard 12 is put into its desired position against a suitable structural base, such as a vertical wall stud 48, covering half of the front face 50 of the stud 48, thus adhering adhesive film 34 to the stud face 50, as shown in FIG. 4. Wallboard 14, with flap 46 also folded back 270°, is shown being similarly mounted against stud face 50, adjacent wallboard 12. Wall stud 48 could be either a wood stud or a metal stud or the suitable structural base could be a previously completed plaster or paneled wall, or equivalent.

Figure 5:
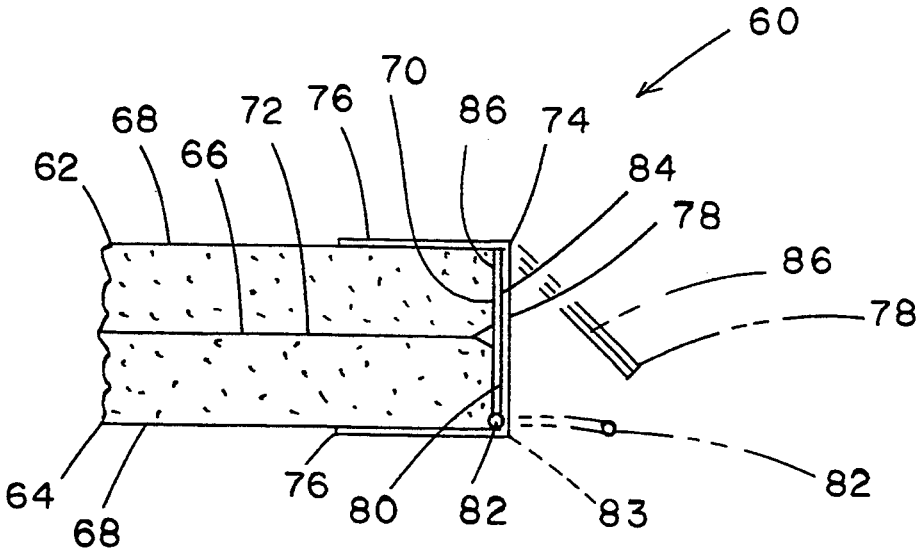
FIG. 5 is an end view of a modified form of a wallboard package showing the protective edge tape, both after application onto the two wallboards and as the tear cord is severing the protective edge tape.
Figure 6:
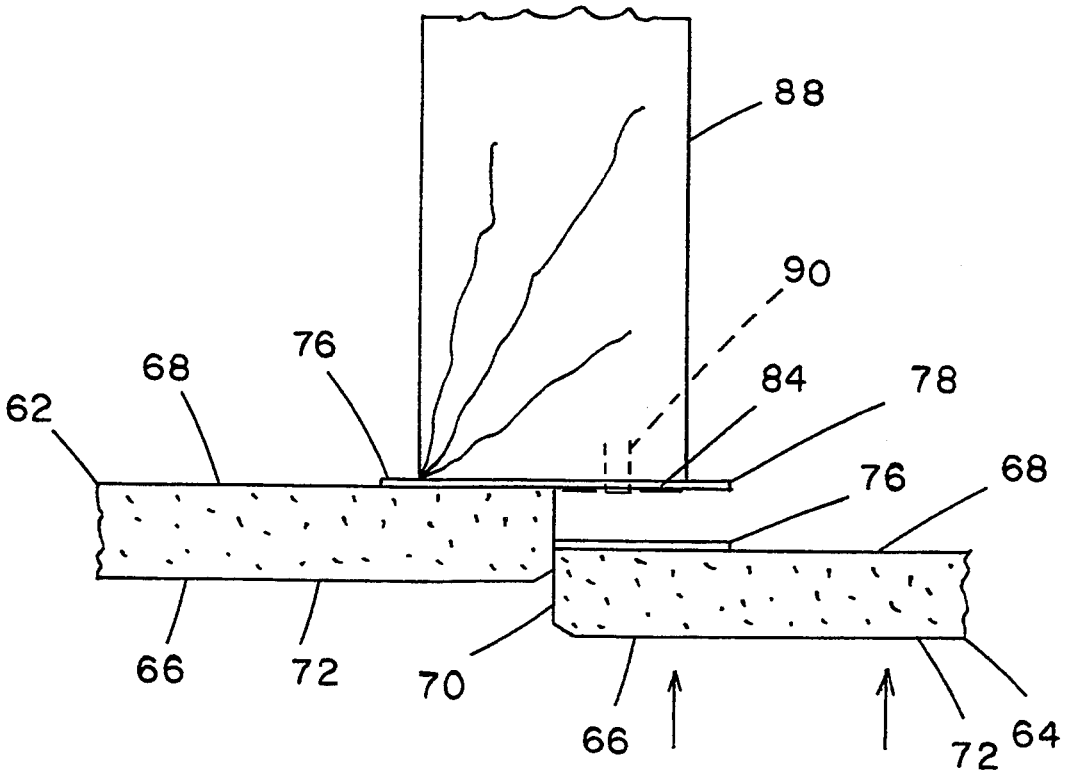
FIG. 6 is an end view of the two wallboards of FIG. 5, one mounted on a wall stud and the second being moved into place adjacent the first.

Referring to FIGS. 5 and 6, there is shown an edge portion 60 of a package of two predecorated, half-inch gypsum wallboards 62, 64, each with a front face 66, a back face 68 and two side edges 70 (one side edge not shown). A face paper 72, on the front face 66 and side edges 70, is predecorated, and, to protect the predecorated side edges 70, a novel protective edge tape 74 is wrapped around the side edges 70.

Edge tape 74 is about three inches wide, also made of tear-resistant material, and has a one-inch-wide edge portion 76 along each side of the tape 74 which is adhered to the back face 68 of each wallboard 62, 64. Tape 74 has a center portion 78, one-inch wide, disposed over the side edges 70.

Center portion 78 has an inner surface 80 along one edge of which is disposed a tear cord 82, and a relatively weak tear line 83. Inner surface 80 also has a one-inch-wide, pressure sensitive adhesive film 84 substantially there throughout. Adhesive film 84 has a release liner 86 covering the pressure sensitive adhesive film 84, and separating the adhesive film 84 from the wallboard edges 70.

FIG. 5 shows the protective tape 74 both in the form of a wallboard package edge portion 60 and as the tear cord 82 is severing the edge tape 74, prior to a consumer mounting the two wallboards 62, 64. After the edge tape 74 is severed by the tear cord 82, the center portion 78 is folded outwardly 90°.

The wallboards 62, with center portion 78 still attached, is then put into its desired position against a suitable structural base, such as a vertical wall stud 88. Center portion 78, with adhesive film 84 facing away from stud 88, is affixed to stud 88 with a plurality of staples 90. Wallboard 64 is shown being mounted adjacent wallboard 62, with the back face 68 about to be adhered to adhesive film 84.

Figure 7:
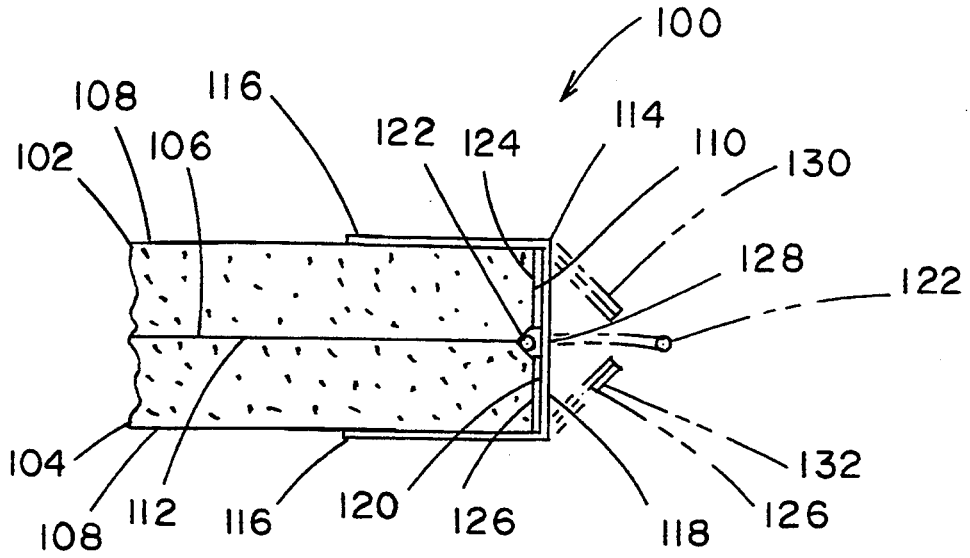
FIG. 7 is an end view of a further modified form of a wallboard package showing the protective edge tape, both after application and as the tear cord is severing the protective edge tape.
Figure 8:
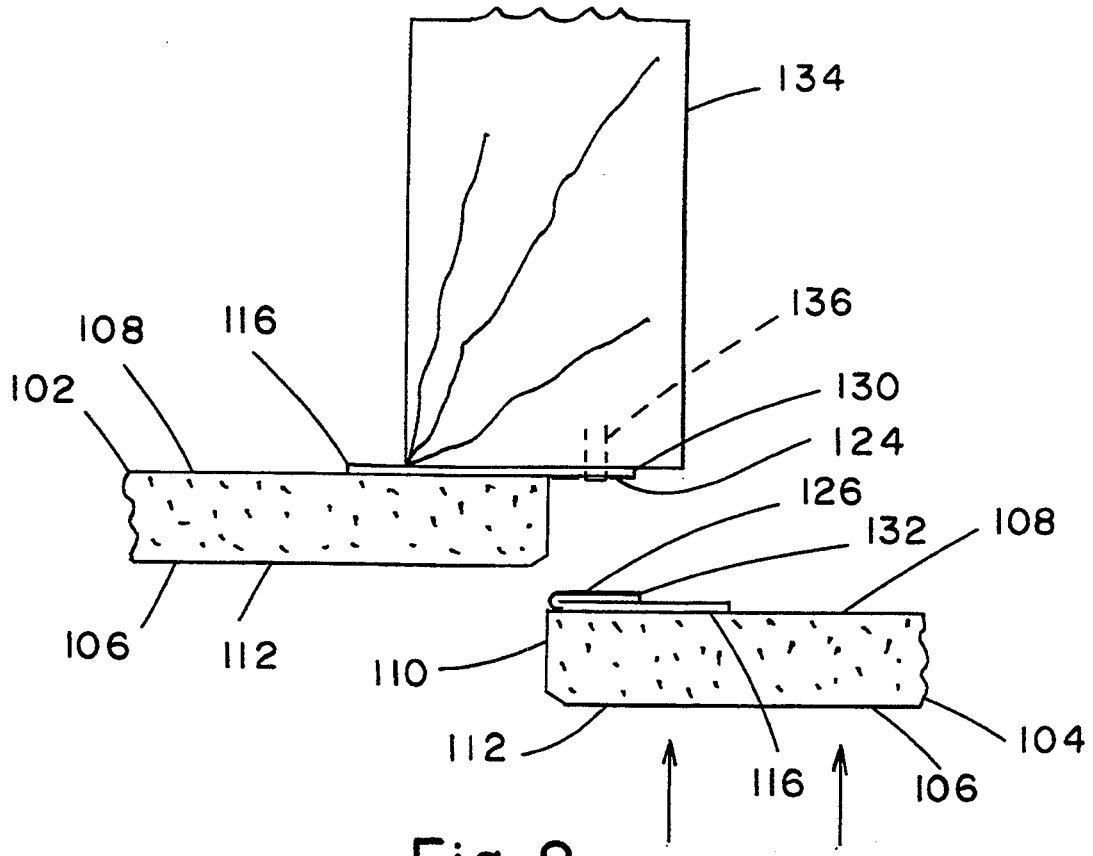
FIG. 8 is an end view of the two wallboards of FIG. 7, one mounted on a wall stud and the other being moved into place adjacent the first.

Referring to FIGS. 7 and 8, there is shown an edge portion 100 of a package of two predecorated, half-inch gypsum wallboards 102, 104, each with a front face 106, a back face 108 and two side edges 110 (one side edge not shown). A face paper 112, on the front face 106 and side edges 110, is predecorated, and, to protect the predecorated side edges 110, a novel protective edge tape 114 is wrapped around the side edges 110.

Edge tape 114 is about three inches wide, also made of tear-resistant material, and has a one-inch-wide edge portion 116 along each side of the tape 114 which is adhered to the back face 108 of each wallboard 102, 104. Tape 114 has a center portion 118, one-inch wide, disposed over the side edges 110.

Center portion 118 has an inner surface 120 along the center of which is disposed a tear cord 122. Inner surface 120 also has two contact adhesive films 124, 126; film 124 being on one side of tear cord 122 and film 126 being on the other side of tear cord 122. The surfaces of the two contact adhesive films 124, 126 will only adhere to a surface with the same coating.

FIG. 7 shows the protective edge tape 114, both in the form of a wallboard package edge portion 100 and as the tear cord 122 is severing the edge tape 114, prior to a consumer mounting the two wallboards 102, 104. After the edge tape 114 is severed along a relatively weaker centerline 128 by the tear cord 122, wallboard 102 is left with flap 130 and wallboard 104 with flap 132. Flaps 130, 132 are the two halves of center portion 118, each with an adhesive film 124, 126.

Wallboard 102, with flap 130 folded outwardly 90°, is then put into its desired position against a suitable structural base, such as a vertical wall stud 134. Flap 130, with adhesive film 124 facing away from stud 134, is affixed to stud 134 with a plurality of staples 136. Wallboard 104, with flap 132 folded back 270°, is shown being mounted adjacent wallboard 102, with the adhesive film 126 about to be adhered to the adhesive film 124, of flap 130.

Having completed a detailed description of the preferred embodiments of my invention so that those skilled in the art may practice the same, I contemplate that variations may be made without departing from the essence of the invention.

I claim:

1. A wallboard package comprising two wallboards affixed together, said wallboards having board edge portions for attachment to a structural base, and an elongate, narrow tape affixed to said two wallboards, each said wallboard having a front face, a back face and an edge, said tape including an elongate center portion and two elongate tape edge portions, said two elongate tape edge portions being affixed respectively to the back faces of said two wallboards, and said elongate center portion extending across said wallboard edges, said elongate center portion having an inner surface with an adhesive film thereon, whereby said elongate center portion may be severed to separate said two wallboards with a substantial portion of said center portion and said adhesive film remaining connected to said board edge portion of at least one of said wallboards, said substantial portion of said center portion being for use in mounting said wallboard on said structural base.

2. A wallboard package as defined in claim 1, wherein said adhesive film is a pressure sensitive adhesive with a release liner covering said pressure sensitive adhesive.

3. A wallboard package as defined in claim 1, wherein said adhesive film is a contact adhesive which will only adhere to another contact adhesive film.

4. A wallboard package as defined in claim 1, wherein a tear cord is disposed along a junction of said tape center portion and one of said tape edge portions.

5. A wallboard package as defined in claim 4, wherein said adhesive film is a pressure sensitive adhesive with a release liner covering said pressure sensitive adhesive.

6. A wallboard package as defined in claim 1, wherein a tear cord is disposed along an elongate centerline of said tape center portion and said center portion inner surface has two adhesive films thereon located one on each side of said tear cord.

7. A wallboard package as defined in claim 6, wherein said adhesive films are of a pressure sensitive adhesive with a release liner covering said pressure sensitive adhesive.

8. A wallboard package as defined in claim 6, wherein said adhesive films are of a contact adhesive which will only adhere to another contact adhesive film.

9. A wallboard package as defined in claim 1, wherein said elongate, narrow tape is a tear-resistant material with a relatively weak tear line and with an adhesive film coated thereon.

10. A method of packaging and subsequently mounting gypsum wallboard on a suitable structural base comprising the steps of combining two wallboards face-to-face by adhering an elongate edge tape, containing wallboard mounting means, along edges of said two wallboards with tape edge portions adhered to back faces of said two wallboards and a tape center portion extending across the edges of the two wallboards, wherein said mounting means comprises an adhesive on said tape center portion, and subsequently severing said edge tape and mounting said wallboards on said suitable structural base by securing said center portion containing said mounting means to affix said wallboards to said structural base.

11. The method of claim 10, wherein said mounting means is an adhesive film and wherein said tape is severed along a single tear line leaving at least a substantial portion of said center portion with an adhesive film connected to at least one of said wallboards, and wherein at least one of said wallboards is mounted by being adhered in place relative to said structural base.

12. The method of claim 11, wherein said adhesive film is a pressure sensitive adhesive, further comprising severing said center portion along a centerline of said center portion forming a pair of flaps, each including said adhesive film, folding said flaps back 270°, and mounting said wallboards with said pressure sensitive adhesive film adhered to said structural base.

13. The method of claim 11, wherein said adhesive film is a pressure sensitive adhesive, further comprising severing said center portion along a junction of said center portion and a tape edge portion, folding said center portion outwardly 90°, placing said center portion against said structural base, fastening said center portion to said structural base using suitable fastening means, and adhering said wallboard having no center portion connected thereto by placing said wallboard against said adhesive film.

14. The method of claim 11, wherein said adhesive film is a contact adhesive which will adhere only to another surface of contact adhesive, further comprising severing said center portion along a centerline of said center portion forming a pair of flaps, each including said adhesive film, folding a flap on a first said wallboard outwardly 90°, fastening said flap to said structural base using suitable fastening means, folding a flap on a second said wallboard back 270°, and placing said flaps of said two wallboards firmly together to mount said second wallboard.

15. The method of claim 10, wherein said severing is accomplished by using a tear cord disposed on said center portion inner surface.

16. The method of claim 10, wherein said tape is comprised of tear-resistant material further comprising forming a series of perforations in said tape forming a relatively weak tear line.

17. The method of claim 10, wherein said elongate edge tape is formed by laminating a fabric scrim to a fiber-reinforced paper.

18. The method of claim 10, wherein said elongate edge tape is formed by laminating plies of material and separating some, but not all plies along a relatively weak tear line.

* * * * *